US008132338B2

(12) United States Patent
Deem et al.

(10) Patent No.: US 8,132,338 B2
(45) Date of Patent: Mar. 13, 2012

(54) ENERGY-EFFICIENT YANKEE DRYER HOOD SYSTEM

(75) Inventors: Charles E. Deem, De Pere, WI (US); Mark S. Hunter, Green Bay, WI (US); Donald J. Hodkiewicz, Green Bay, WI (US); Steven W. Monroe, Green Bay, WI (US); Scott M. Thomson, Lena, WI (US); Thomas H. Barrie, Green Bay, WI (US); Timothy D. Jadin, Green Bay, WI (US); Steven M. Gardner, De Pere, WI (US); Scott L. Giannunzio, Oneida, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 164 days.

(21) Appl. No.: 12/754,656

(22) Filed: Apr. 6, 2010

(65) Prior Publication Data

US 2010/0192403 A1 Aug. 5, 2010

Related U.S. Application Data

(63) Continuation of application No. 11/740,533, filed on Apr. 26, 2007, now Pat. No. 7,716,850.

(60) Provisional application No. 60/746,277, filed on May 3, 2006.

(51) Int. Cl.
*F26B 3/02* (2006.01)

(52) U.S. Cl. ..... 34/454; 34/444; 34/466; 34/497; 162/198; 162/274

(58) Field of Classification Search ..... 34/380, 34/381, 413, 444, 454, 466, 497; 162/274, 162/198

See application file for complete search history.

(56) References Cited

U.S. PATENT DOCUMENTS

| | | | |
|---|---|---|---|
| 1,470,650 | A | 10/1923 | Smith |
| 2,268,988 | A | 1/1942 | Hess et al. |
| 2,348,178 | A | 5/1944 | Merle |
| 2,515,651 | A | 7/1950 | Harrison et al. |
| 2,554,239 | A | 5/1951 | Caulfield et al. |
| 2,575,426 | A | 11/1951 | Parnell |
| 2,643,107 | A | 6/1953 | Kamm et al. |
| 2,721,144 | A | 10/1955 | Penley |
| 2,791,039 | A | 5/1957 | Rosenbaum |
| 2,828,752 | A | 4/1958 | Jackson |
| 2,932,092 | A | 4/1960 | Rosenbaum |
| 2,933,826 | A | 4/1960 | Justus |
| 3,076,729 | A | 2/1963 | Garbo |
| 3,208,158 | A | 9/1965 | Smith, Jr. |
| 3,231,985 | A | 2/1966 | Smith, Jr. |
| 3,235,972 | A | 2/1966 | Hood et al. |
| 3,252,415 | A | 5/1966 | Crawford |
| 3,377,056 | A | 4/1968 | Boye |

(Continued)

*Primary Examiner* — Stephen M. Gravini

(74) *Attorney, Agent, or Firm* — Laura L. Bozek

(57) ABSTRACT

A paper machine configured as a swing machine capable of producing both light and heavy grades providing a Yankee hood split into a wet end half and a dry end half, at least one hood half being a flex-hood half wherein the supply for that half is capable of being run with either combustion heat or recycled heat and is capable of either recirculating the exhaust from the hood or discharging it to the atmosphere. The heater for the flex-hood half comprises both a primary combustion heat source and an indirect heat source capable of extracting by-product heat from another operation. The exhaust system for the flex hood half is capable of being run in either a straight through mode or in a recirculating mode.

3 Claims, 5 Drawing Sheets

U.S. PATENT DOCUMENTS

| | | | |
|---|---|---|---|
| 3,403,643 | A | 10/1968 | Denig |
| 3,486,345 | A | 12/1969 | Waldin |
| 3,643,344 | A | 2/1972 | Strube |
| 3,645,006 | A | 2/1972 | Anderson |
| 3,688,785 | A | 9/1972 | Stevens et al. |
| 3,771,236 | A | 11/1973 | Candor et al. |
| 3,791,049 | A | 2/1974 | Smith, Jr. |
| 3,793,741 | A | 2/1974 | Smith, Jr. |
| 3,836,681 | A | 9/1974 | Dodd |
| 3,884,161 | A | 5/1975 | Ankersen |
| 3,884,163 | A | 5/1975 | Ankersen |
| 3,891,500 | A | 6/1975 | Kankaanpaa |
| 3,962,213 | A | 6/1976 | Flynn |
| 4,074,441 | A | 2/1978 | Helversen et al. |
| 4,083,745 | A | 4/1978 | Muller |
| 4,124,942 | A | 11/1978 | Ohls |
| 4,151,689 | A | 5/1979 | Schabert |
| 4,154,644 | A | 5/1979 | Ericsson |
| RE30,169 | E | 12/1979 | Flynn |
| 4,185,399 | A | 1/1980 | Gladish |
| 4,247,990 | A | 2/1981 | Ohls |
| 4,248,671 | A | 2/1981 | Belding |
| 4,268,974 | A | 5/1981 | Price |
| 4,287,138 | A | 9/1981 | Buckner |
| 4,297,167 | A | 10/1981 | Schabert |
| 4,365,425 | A | 12/1982 | Gotchel |
| 4,367,699 | A | 1/1983 | Evans |
| 4,378,207 | A | 3/1983 | Smith |
| 4,413,427 | A | 11/1983 | Villalobos et al. |
| 4,423,956 | A | 1/1984 | Gordon |
| 4,425,763 | A | 1/1984 | Porta et al. |
| 4,457,703 | A | 7/1984 | Ross |
| 4,462,169 | A | 7/1984 | Daane |
| 4,462,868 | A | 7/1984 | Oubridge et al. |
| 4,474,552 | A | 10/1984 | Smith |
| 4,487,139 | A | 12/1984 | Warner |
| 4,502,228 | A | 3/1985 | Helbig et al. |
| 4,504,220 | A | 3/1985 | Sunakawa et al. |
| 4,523,390 | A | 6/1985 | McCarthy |
| 4,526,112 | A | 7/1985 | Warner |
| 4,534,312 | A | 8/1985 | Shinya et al. |
| 4,557,202 | A | 12/1985 | Warner |
| 4,577,380 | A | 3/1986 | Warner |
| 4,589,843 | A | 5/1986 | Smith |
| 4,598,555 | A | 7/1986 | Windecker |
| 4,624,109 | A | 11/1986 | Minovitch |
| 4,627,176 | A | 12/1986 | Brieu |
| 4,669,530 | A | 6/1987 | Warner |
| 4,728,287 | A | 3/1988 | Niems |
| 4,776,391 | A | 10/1988 | Warner |
| 4,780,967 | A | 11/1988 | Mucic |
| 4,940,134 | A | 7/1990 | Aoki et al. |
| 4,949,477 | A | 8/1990 | Geiger |
| 5,009,016 | A | 4/1991 | LePisto et al. |
| 5,024,596 | A | 6/1991 | Smith |
| 5,033,207 | A | 7/1991 | Sturm |
| 5,046,944 | A | 9/1991 | Smith |
| 5,090,898 | A | 2/1992 | Smith |
| 5,130,170 | A | 7/1992 | Kanai et al. |
| 5,162,445 | A | 11/1992 | Powers et al. |
| 5,255,448 | A | 10/1993 | Buckner |
| 5,285,752 | A | 2/1994 | Reed et al. |
| 5,406,008 | A | 4/1995 | Sievert |
| 5,416,979 | A | 5/1995 | Joiner |
| 5,425,792 | A | 6/1995 | Bishop et al. |
| 5,426,167 | A | 6/1995 | Powers et al. |
| 5,430,118 | A | 7/1995 | Powers et al. |
| 5,506,117 | A | 4/1996 | Andrews et al. |
| 5,510,151 | A | 4/1996 | Matsuyama et al. |
| 5,512,312 | A | 4/1996 | Forney et al. |
| 5,520,740 | A | 5/1996 | Kanai et al. |
| 5,548,023 | A | 8/1996 | Powers et al. |
| 5,548,029 | A | 8/1996 | Powers et al. |
| 5,555,856 | A | 9/1996 | Bauer et al. |
| 5,577,575 | A | 11/1996 | Mielo |
| 5,582,271 | A | 12/1996 | Mielo |
| 5,601,707 | A | 2/1997 | Clay et al. |
| 5,629,054 | A | 5/1997 | Kanai |
| 5,654,379 | A | 8/1997 | Powers et al. |
| 5,656,044 | A | 8/1997 | Bishop et al. |
| 5,678,321 | A | 10/1997 | Deshpande et al. |
| 5,683,478 | A | 11/1997 | Anonychuk |
| 5,704,965 | A | 1/1998 | Tom et al. |
| 5,711,086 | A | 1/1998 | Stubbing |
| 5,714,010 | A | 2/1998 | Matsuyama et al. |
| 5,791,065 | A | 8/1998 | Gamble et al. |
| 5,791,566 | A | 8/1998 | Higo et al. |
| 5,815,943 | A | 10/1998 | Puumalainen |
| 5,837,027 | A | 11/1998 | Olander et al. |
| 5,840,101 | A | 11/1998 | Keller |
| 5,851,246 | A | 12/1998 | Bishop et al. |
| 5,865,898 | A | 2/1999 | Holtzapple et al. |
| 5,942,142 | A | 8/1999 | Forney et al. |
| 5,959,049 | A | 9/1999 | Powers et al. |
| 5,974,691 | A | 11/1999 | Marchal et al. |
| 5,976,220 | A | 11/1999 | Braun et al. |
| 6,003,241 | A | 12/1999 | Komulainen et al. |
| 6,085,437 | A | 7/2000 | Stipp |
| 6,096,389 | A | 8/2000 | Kanai |
| 6,128,833 | A | 10/2000 | Juppi et al. |
| 6,138,380 | A | 10/2000 | Veijola et al. |
| 6,149,814 | A | 11/2000 | Allington et al. |
| 6,154,981 | A | 12/2000 | Heikkila et al. |
| 6,209,456 | B1 | 4/2001 | Murray et al. |
| RE37,150 | E | 5/2001 | Anonychuk |
| 6,230,501 | B1 | 5/2001 | Bailey, Sr. et al. |
| 6,248,153 | B1 | 6/2001 | Braun et al. |
| 6,294,088 | B1 | 9/2001 | Allington et al. |
| 6,308,436 | B1 | 10/2001 | Stipp |
| 6,365,004 | B1 | 4/2002 | Hamstrom et al. |
| 6,393,719 | B1 | 5/2002 | Stipp |
| 6,395,226 | B1 | 5/2002 | Plunkett |
| 6,398,909 | B1 | 6/2002 | Klerelid |
| 6,488,816 | B1 | 12/2002 | Klerelid |
| 6,505,437 | B1 | 1/2003 | Johnstone et al. |
| 6,511,052 | B1 | 1/2003 | Tonkin et al. |
| 6,551,461 | B2 | 4/2003 | Hermans et al. |
| 6,554,368 | B2 | 4/2003 | Drake et al. |
| 6,631,566 | B2 | 10/2003 | Ross et al. |
| 6,694,639 | B2 | 2/2004 | Hanaya |
| 6,775,925 | B2 | 8/2004 | Zagar et al. |
| 6,779,577 | B1 | 8/2004 | Kaneko et al. |
| 6,790,315 | B2 | 9/2004 | Klerelid |
| 6,793,079 | B2 | 9/2004 | Khan et al. |
| 6,865,825 | B2 | 3/2005 | Bailey, Sr. et al. |
| 6,869,147 | B2 | 3/2005 | Drake et al. |
| 6,877,246 | B1 | 4/2005 | Hada et al. |
| 6,904,700 | B2 | 6/2005 | Hada et al. |
| 6,910,283 | B1 | 6/2005 | Reddy |
| 6,919,543 | B2 | 7/2005 | Abbott et al. |
| 6,929,330 | B2 | 8/2005 | Drake et al. |
| 6,953,516 | B2 | 10/2005 | Hermans et al. |
| 6,964,117 | B2 | 11/2005 | Parent |
| 6,977,028 | B2 | 12/2005 | Ross et al. |
| 7,089,682 | B2 | 8/2006 | Sundqvist et al. |
| 7,107,706 | B1 | 9/2006 | Bailey, Sr. et al. |
| 7,117,827 | B1 | 10/2006 | Hinderks |
| 7,143,525 | B2 | 12/2006 | Hada et al. |
| 7,176,420 | B2 | 2/2007 | Abbott et al. |
| 7,204,041 | B1 | 4/2007 | Bailey, Sr. et al. |
| 7,225,558 | B2 | 6/2007 | Hagen et al. |
| 7,266,965 | B2 | 9/2007 | Blackstone |
| 7,266,966 | B2 | 9/2007 | Blackstone |
| 7,326,263 | B2 | 2/2008 | Andersen |
| 7,328,806 | B2 | 2/2008 | Khan et al. |
| 7,381,931 | B2 | 6/2008 | Hayashi et al. |
| 7,389,255 | B2 | 6/2008 | Formisano |
| 7,399,325 | B1 | 7/2008 | Redmond |
| 7,410,619 | B2 | 8/2008 | Reiser et al. |
| 7,429,311 | B2 | 9/2008 | Pietikainen et al. |
| 7,438,027 | B1 | 10/2008 | Hinderks |
| 7,530,403 | B2 | 5/2009 | Cano |
| 7,531,029 | B2 | 5/2009 | Hoke et al. |
| 7,578,285 | B2 | 8/2009 | Buelow et al. |
| 7,610,780 | B2 | 11/2009 | Malaguti |
| 7,611,792 | B2 | 11/2009 | Tonkin et al. |
| 2001/0045104 | A1 | 11/2001 | Bailey, Sr. et al. |

2002/0014080 A1 2/2002 Robbie et al.
2002/0096512 A1 7/2002 Abbott et al.
2002/0176809 A1 11/2002 Siess
2002/0179269 A1 12/2002 Klerelid
2003/0019125 A1 1/2003 Hanaya
2003/0019601 A1 1/2003 Hermans et al.
2003/0024686 A1 2/2003 Ouellette
2003/0025219 A1 2/2003 Tonkin et al.
2003/0089474 A1 5/2003 Zwick et al.
2003/0121906 A1 7/2003 Abbott et al.
2003/0127030 A1 7/2003 Cardin et al.
2003/0145481 A1 8/2003 Zagar et al.
2003/0153059 A1 8/2003 Pilkington et al.
2003/0221438 A1 12/2003 Rane et al.
2004/0003906 A1 1/2004 Hermans et al.
2004/0005252 A1 1/2004 Siess
2004/0033739 A1 2/2004 Courtney
2004/0099575 A1 5/2004 Khan et al.
2004/0118009 A1 6/2004 Parent
2004/0128858 A1 7/2004 Sundqvist et al.
2004/0131541 A1 7/2004 Andersen
2004/0168459 A1 9/2004 Blackstone
2004/0256294 A1 12/2004 Khan et al.
2005/0016199 A1 1/2005 Blackstone
2005/0051465 A1 3/2005 Khan et al.
2005/0072023 A1 4/2005 Hada et al.
2005/0108982 A1 5/2005 Formisano
2005/0132598 A1 6/2005 Reddy
2005/0138832 A1 6/2005 Hada et al.
2005/0155734 A1 7/2005 Hermans et al.
2005/0175665 A1 8/2005 Hunter et al.
2005/0175703 A1 8/2005 Hunter et al.
2005/0178138 A1 8/2005 Blackstone
2005/0178395 A1 8/2005 Hunter et al.
2005/0178396 A1 8/2005 Hunter et al.
2005/0182463 A1 8/2005 Hunter et al.
2005/0183731 A1 8/2005 Hunter et al.
2005/0186244 A1 8/2005 Hunter et al.
2005/0187140 A1 8/2005 Hunter et al.
2005/0196421 A1 9/2005 Hunter et al.
2005/0208095 A1 9/2005 Hunter et al.
2005/0214408 A1 9/2005 Pilkington et al.
2005/0224236 A1 10/2005 Cano
2005/0230378 A1 10/2005 Abbott et al.
2005/0236400 A1 10/2005 Abbott et al.
2005/0247694 A1 11/2005 Abbott et al.
2005/0247699 A1 11/2005 Abbott et al.
2005/0274499 A1 12/2005 Rule
2006/0021249 A1 2/2006 Hagen et al.
2006/0041448 A1 2/2006 Patterson et al.
2006/0051516 A1 3/2006 Pietikainen et al.
2006/0137886 A1 6/2006 Cano
2006/0154190 A1 7/2006 Reiser et al.
2006/0257999 A1 11/2006 Chang et al.
2006/0259195 A1 11/2006 Eliuk et al.
2006/0272508 A1 12/2006 Hoke et al.
2007/0051009 A1 3/2007 Hada et al.
2007/0107701 A1 5/2007 Buelow et al.
2007/0151216 A1 7/2007 Charriere
2007/0215004 A1 9/2007 Kuroda et al.
2007/0231877 A1 10/2007 Choate
2008/0004477 A1 1/2008 Brunsell et al.
2008/0034606 A1 2/2008 Deem et al.
2008/0066484 A1 3/2008 Blackstone
2008/0119673 A1 5/2008 Hechler et al.
2008/0207970 A1 8/2008 Meurer et al.
2009/0042281 A1 2/2009 Chang et al.
2009/0044932 A1 2/2009 Blackstone
2009/0126260 A1 5/2009 Aravanis et al.
2009/0216910 A1 8/2009 Duchesneau
2009/0218108 A1 9/2009 Cano
2009/0272361 A1 11/2009 Buelow et al.
2009/0280036 A1 11/2009 Reiser et al.
2009/0288311 A1 11/2009 Da Silva et al.

ENERGY-EFFICIENT YANKEE DRYER HOOD SYSTEM

CROSS REFERENCE TO RELATED APPLICATIONS

This application is a continuation of U.S. application Ser. No. 11/740,533, filed Apr. 26, 2007, which claims the benefit of U.S. Provisional Application Ser. No. 60/746,277, filed May 3, 2006. The priorities of the foregoing applications are hereby claimed and the entirety of their disclosures incorporated herein by reference.

SUMMARY OF THE INVENTION

Vast amounts of energy are used in the manufacture of paper products. Paper is traditionally formed by depositing an extremely dilute suspension of cellulosic fibers in water on a moving foraminous support to form a nascent web, dewatering the nascent web to a consistency of between about 35 and 48 percent, then evaporating the remaining water from the dewatered nascent web. Since it requires approximately a thousand BTU's (1,055,055 joules) to evaporate each pound (453.6 grams) of water, and is extremely difficult to dewater the nascent web to a consistency of greater than about 95%, it can be appreciated that a paper machine capable of producing around 300 tons (304,814 kilograms) of paper in 24 hours will use enough energy to heat several hundred medium sized houses over an entire heating season.

In the case of absorbent paper products, tissue, primarily bath tissue, toweling (kitchen roll toweling, hand towels, wipers), facial tissue and napkins, the dewatered nascent web is often dried by adhering the dewatered nascent web to an extremely large internally heated rotating cast-iron cylinder referred to as a Yankee dryer, with the web being removed from the Yankee dryer by creping. Even though the heat transfer between the Yankee and the dewatered nascent web is extremely good, Yankee dryers typically are largely encompassed by a hood which directs heated air against the nascent web upon the surface of the Yankee to further augment the drying rate. This invention relates to an extremely flexible arrangement for managing Yankee dryer hoods to enable the operators to match the energy consumption required to the demands of the particular product being manufactured at any one time.

Often paper machines will be configured as "swing machines"—machines capable of producing several grades of tissue (facial or bath) and toweling depending on particular market demands. In most cases, toweling grades will be considerably heavier than tissue grades, so more energy is often required for toweling grades than tissue. Similarly, the lightest tissue grades may be under 9½ pounds per ream (15.46 g/M$^2$) while heavier grades may have a basis weight of over 13 pounds per ream (21.16 g/M$^2$); so there is also considerable variation between heating load for the lighter weights as compared to the heavier weights of tissue. We are able to address the energy requirements for both heavy and light grades in a cost-effective and flexible manner by providing a hood which is split into a wet end half and a dry end half, at least one hood half being a flex-hood half wherein the supply source for that half is capable of being run with either combustion heat or recycled heat and is capable of either recirculating the exhaust from the hood or discharging it to the atmosphere. Accordingly, the heater for the flex-hood half comprises both a primary combustion heat source and an indirect heat source capable of extracting heat which is a by-product of another operation in the mill while the exhaust system for that hood half is capable of being run in either a straight through mode in which the exhaust from the hood half is discharged to the atmosphere or in a recirculating mode in which the bulk of the exhaust is returned to the heater to be reheated then passed through the hood half again with makeup air being introduced primarily to make up for air lost around the hood edges as well as exhaust bled off to limit hood humidity. Accordingly, the exhaust system incorporates ductwork capable of either returning the bulk of the exhaust gas from the flex hood half to the heater section or discharging (with heat recovery) that exhaust gas to the atmosphere along with a diverter to control how the exhaust is handled. In either case, there will generally be at least some discharge to the atmosphere to prevent excessive buildup humidity in the loop.

DESCRIPTION OF A PREFERRED EMBODIMENT

Figure 1:
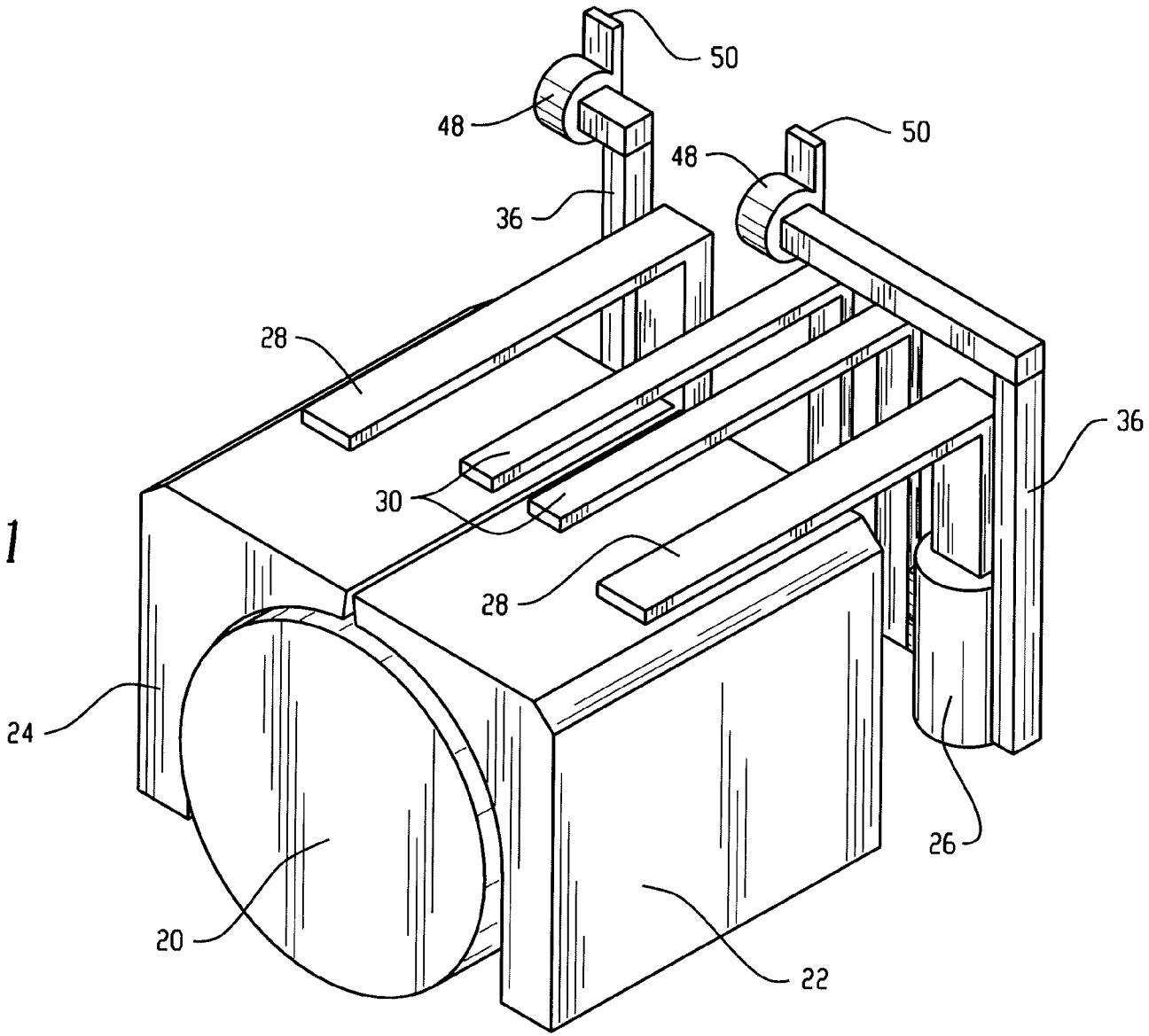
FIG. 1 is a schematic isometric perspective illustrating the tending side of a Yankee dryer set up with two flexible hood halves.
Figure 2:
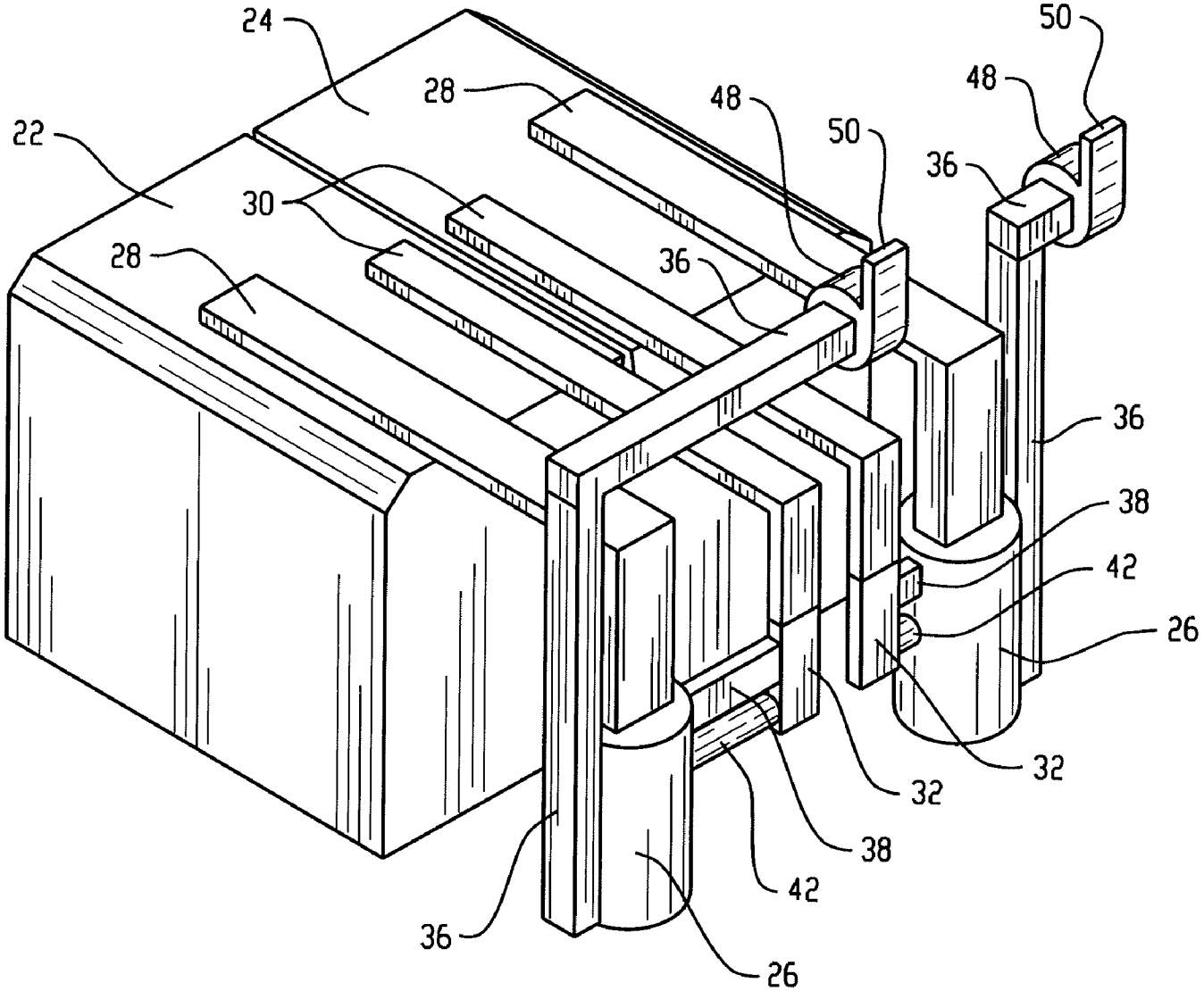
FIG. 2 is a schematic isometric perspective illustrating the drive side of a Yankee dryer set up with two flexible hood halves.
Figure 5:
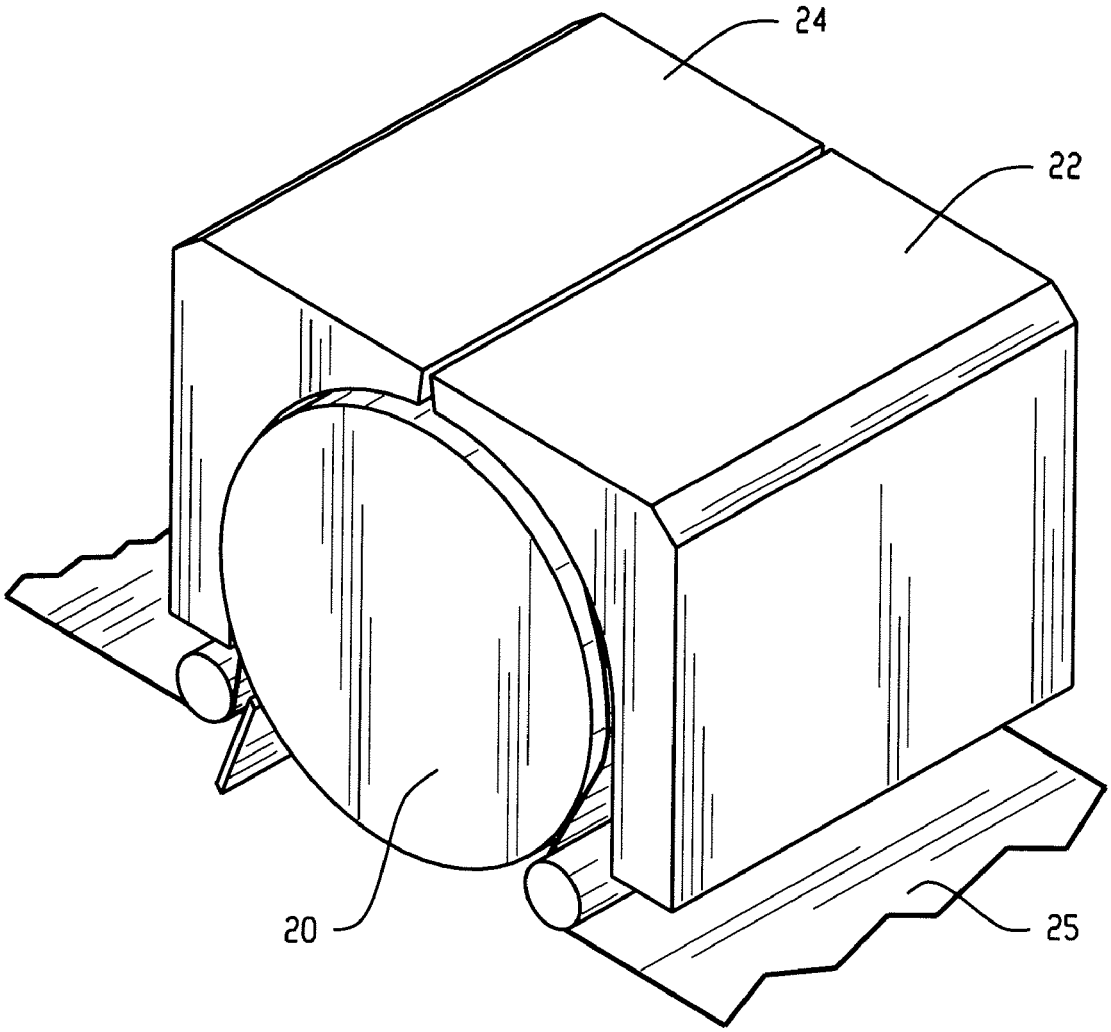
FIG. 5 is schematic isometric perspective illustrating the drive side of a Yankee dryer showing the paper flow therethrough.

In FIGS. 1 and 2, Yankee dryer cylinder 20 is partially encompassed on its wet end side by wet end dryer hood half 22 and by dry end dryer hood half 24 on its dry end side. In the preferred embodiment, each hood half has substantially the same operability; so only the wet end hood half need be described, although in some cases it may be convenient to omit the below described straight through operation mode from one hood half but not the other. In the preferred construction, in each hood half for drying of tissue 25 (FIG. 5) on Yankee cylinder, heated air, typically ranging in temperature from perhaps 600 to 950° F. (315.6 to 510° C.), is supplied through its respective heater 26 connected to supply duct 28 which delivers the heated air to hood half 22 or 24. Moisture laden "cool" air, at perhaps 400 to 500° F. (204.4 to 260° C.), is removed from hood half 22 or 24 through exhaust duct 30 leading to junction 32. In junction 32, it is possible to either (i) direct exhaust air either to upper port 40 (FIG. 3) for additional heating by burner 52 (FIG. 3) and thence back to its respective hood half 22 or 24 or (ii) through lower port 42 connected to air-to-air heat exchanger 43 (FIG. 3) so that heat in the exhaust may be recovered and the exhaust moisture laden cooled air exhausted to the atmosphere through external exhaust duct 36.

Figure 3:
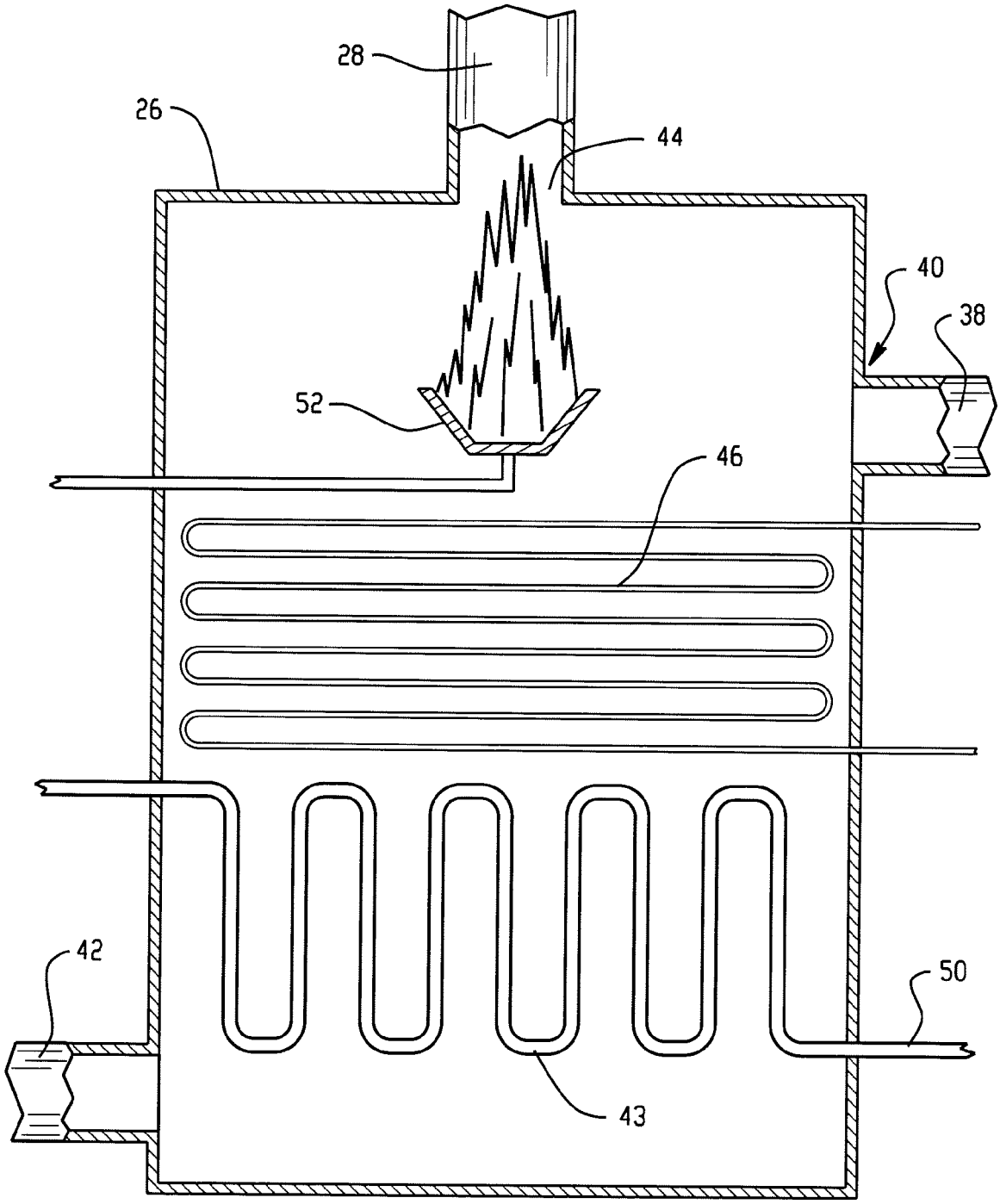
FIG. 3 illustrates a schematic cross section of a burner usable in connection with the present invention.

As shown in FIG. 3, when the exhaust from the hood is directed to upper port 40, moisture laden cool air returns to heater 26 through return duct 38 while makeup air enters through lower port 42 to offset leakage around the edges of hood half 22 or 24 (FIGS. 1 and 2) as well as to prevent build-up of excessive humidity in the hood. The combined reheated stream exits through exhaust port 44 leading back to hood half 22 or 24. Optionally, make-up air entering through lower port 42 may be preheated with process waste heat available from elsewhere in the mill as it passes over process heat exchanger coil 46.

As shown in FIGS. 1, 2, and 3, moisture laden cool air can alternatively be directed through lower port 42, through air-to-air heat exchanger 43, impelled through external exhaust duct 36 by exhaust fan 48 and exhausted through external exhaust port 50. In this case, when moisture laden cool air is not returned to heater 26 for reheating but rather is used to assist in preheating the stream of fresh air supplied to hood half 22 or 24, it is not necessary to operate burner 52, all of the necessary heat being supplied as make-up air passes over air-to-air heat exchanger 43 and water-to-air process heat exchanger coil 46 which is heated through externally generated steam or hot water supplied as process waste heat from elsewhere in the mill.

Figure 4:
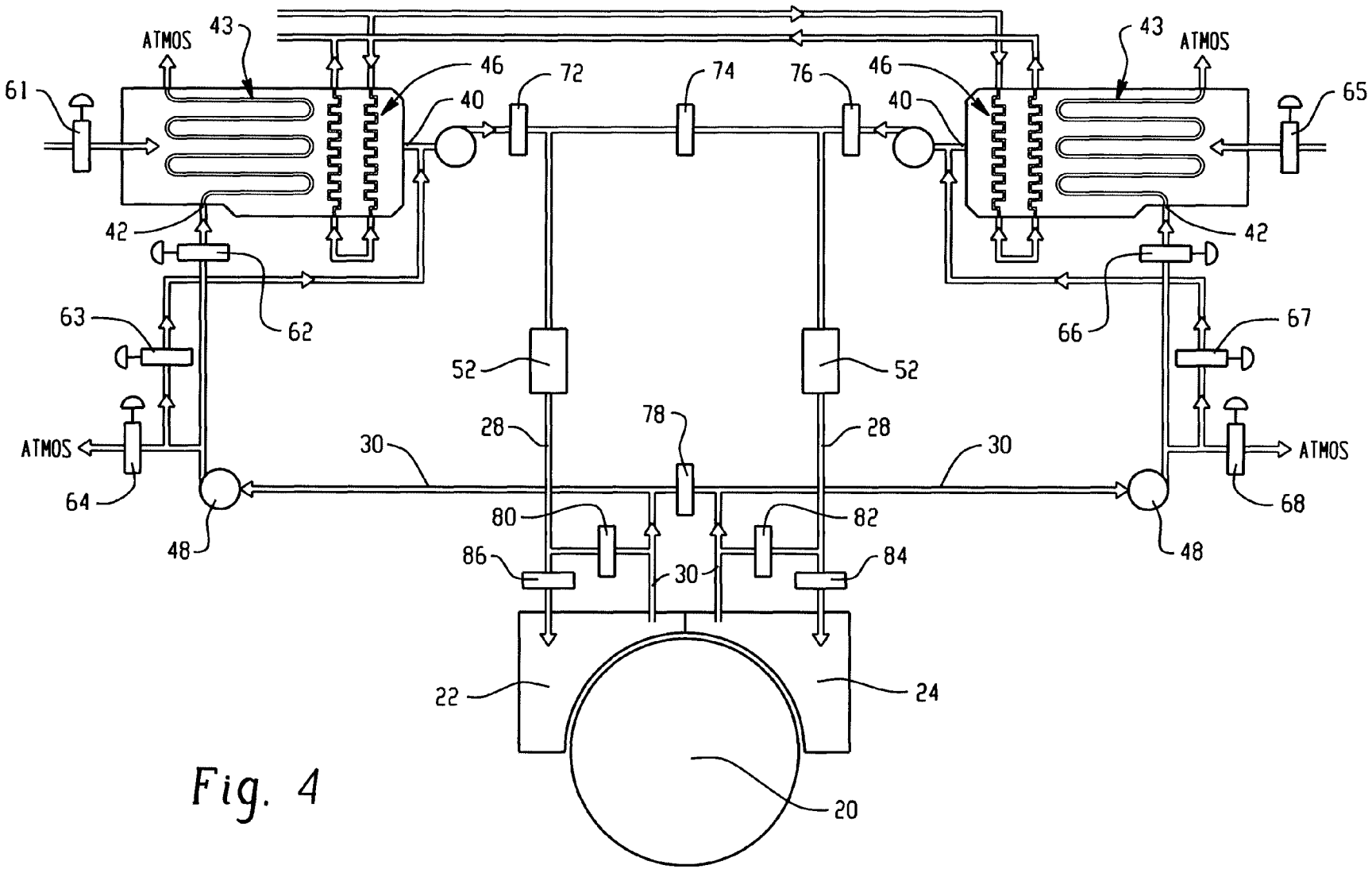
FIG. 4 illustrates another variant of a split hood system of the present invention for supply, removal and recirculation of heated air.

In FIG. 4, damper 61 controls entry of makeup air into air-to-air heat exchanger 43 and process heat exchanger coil 46 prior to entry into supply duct 28 leading through burner 52 to wet end hood half 22 partially encompassing the wet end of Yankee dryer cylinder 20. Moisture laden cool air exits wet end hood half 22 through hood exhaust duct 30. The ultimate disposition of moisture laden cool air in duct 30 is controlled jointly by dampers 62 and 63, damper 62 when open permitting cool moisture laden air to pass through air-to-air heat exchanger 43 prior to being exhausted to the atmosphere, while damper 63, when open, permits cool moisture laden air to be recirculated through burner 52 to wet end hood half 22. In most cases, damper 61 will be open partially, typically approximately 15%, damper 62 being adjusted in the range 20 to 60% to maintain the moisture in the recirculating loop at the desired level.

Similarly, on the dry inside, damper 65 controls entry of air into air-to-air heat exchanger 43 and process heat exchanger coil 46 prior to entry into supply duct 28 leading through burner 52 to dry end hood half 24 encompassing the dry end of Yankee dryer cylinder 20. Moisture laden cool air exits dry end hood half 24 through hood exhaust duct 30, the ultimate disposition of moisture laden cool air being controlled by dampers 66 and 67, air passing through damper 66 flowing through air-to-air heat exchanger 43 before being discharged to the atmosphere. Air flowing through damper 67 is recirculated through burner 52 to dry end hood half 24 with moisture build-up being controlled as above.

In cases where a heavier grade is being manufactured, it will often be advantageous to operate the Yankee with both hood halves being in the recirculating mode, i.e., with both exhaust streams being directed back to the supply duct for the respective hood half with significant operational efficiency being gained by preheating the makeup air for both hood halves 22 and 24 by use of process waste heat supplied through process heat exchanger coils 46. However, when lighter grades, such as lightweight bath tissue base sheet, particularly bath tissue base sheet for 2-ply tissue grades are being produced, it will often be advantageous for the wet end hood half to be operated in the recirculating mode with only a small part of the exhaust being discharged through the air-to-air heat exchanger 43 and the burner 52 in full operation while the dry end half is operated in the straight through mode, i.e., exhaust being directed though the air-to-air heat exchanger 43 and only recovered heat from the hood exhaust and process waste heat being used to supply the heat required for drying, burner not being operated. In this way, because the exhaust off of the Yankee dryer cylinder 20 is not recirculated, it is possible to dry the tissue on the dry end half of the Yankee with air at a temperature around 350 to 450° F. (176.7 to 232.2° C.) preventing a great deal of heat waste. Normally when the exhaust from a Yankee is recirculated, it is necessary to use far higher drying temperatures, typically greater than about 550° F. (287.8° C.), to ensure that loose fibers entrained in the gas stream are combusted fully before reentry into the hood half or the resulting sheet may be degraded in quality and appearance.

In one case, the split hood system of the present invention was operated on a 300 ton (304,814 kilogram) per year swing machine producing approximately 60% heavy weight tissue and the remainder light. When heavy tissue was being produced, the hood system was operated in a recirculating mode with damper 61 open approximately 15% to allow fresh make-up air to be bled into the system preventing excessive build up of humidity in the drying circuit, damper 62 open from about 20 to 60% (depending upon the humidity experienced in the drying, the humidity in the drying circuit desirably being maintained between about 0.2 and 0.7 pounds (90.7 and 317.5 grams) of water per pound (453.6 grams) of dry air) allowing heat in moisture laden air being discharged from the system to preheat the make-up air entering through damper 61, damper 63 open 100% to facilitate a high degree of recirculation of heated air with damper 64 closed. On the dry end side of the hood, damper 65 was open about 15% to allow make-up air to be bled into the system, damper 66 being open 20-60% (similarly to damper 63 on the wet end side), damper 67 open 100% and damper 68 fully closed.

When light tissue was being produced, the wet end side was operated similarly to when heavy tissue was being produced but the dry end side was operated with damper 65 open 100%, damper 66 open 100%, damper 67 fully closed and damper 68 fully closed. The energy savings calculated based on fuel consumption rates were in excess of 35% or a million dollars a year at natural gas prices of $9 to $10 per million BTU (1,055,055,900 joules). During this period, dampers 72, 76, 84 and 86 were normally open while dampers 74, 80 and 82 were normally closed.

In other cases, the flexibility to run the wet end in the once through mode and the dry end in recirculating mode may prove beneficial although it is expected that this need would arise less frequently. To provide further flexibility in operation of the machine, it can be appreciated that by appropriate adjustment of the valving system illustrated in FIG. 4, it is possible to use the wet end burner to heat the air supplied to the dry end side of the hood system as might be required in various circumstances.

As our invention, we claim:

1. A method for operating a paper machine for manufacture of absorbent paper, comprising the steps of providing a paper machine having:

(a) a forming loop comprising a headbox and a translating foraminous support;

(b) a dryer section adapted to receive absorbent paper from said forming loop; and (c) a reel adapted to receive absorbent paper from said dryer system;

and a dryer section comprising:

(i) a rotable Yankee dryer cylinder internally heated by steam;

(ii) a wet end hood section encompassing a portion of said Yankee dryer cylinder adjacent Ruining loop;

(iii) a dry end hood section encompassing a portion of said Yankee dryer cylinder adjacent said reel;

(iv) a dryer system exhaust;

(v) a wet end hood supply duct having a process heat exchanger, a first exhaust gas heat exchanger and a first burner disposed therein adapted to supply heated air to said wet end hood section;

(vi) a wet end hood exhaust duct adapted to receive air from said wet end hood section;

(vii) a wet end return duct adapted to supply air from said wet end hood exhaust duct to said wet end hood supply duct;

(viii) a first diverter damper system connected between said wet end hood exhaust duct and said wet end return duct, said first diverter damper being operable to selectively direct a quantity of moisture laden air exhausted from said wet end hood section to said wet end hood supply duct or alternatively to said dryer system exhaust through said first exhaust gas heat exchanger;

(ix) a dry end hood supply duct having a second process heat exchanger, a second exhaust gas heat exchanger and a second burner disposed therein adapted to supply heated air to said dry end hood section;

(x) a dry end hood exhaust duct adapted to receive air from said dry end hood section;

(xi) a dry end return duct adapted to deliver air from said dry end hood exhaust duct to said dry end hood supply duct; and (xii) a second diverter damper system connected between said dry end hood supply duct and said dry end return duct, said second diverter damper system being operable to selectively direct air exhausted from said dry end hood section to said dry end hood supply duct or alternatively to said dryer system exhaust through said second exhaust gas heat exchanger;

and controlling the position of said first diverter damper system to bleed in sufficient air to maintain the humidity in the air supplied to said wet end hood section in the range of between 0.2 and 0.7 pounds of water per pound of dry air at a temperature of over 550° F.; while controlling said second diverter damper system to pass fresh make up air though one of said process heat exchangers and one of said exhaust gas heat exchangers to said dry end hood section at a temperature of between 350° F. and 450° F.; and exhaust air from said dry end hood section to the atmosphere through an exhaust gas heat exchanger.

2. A method for operating a paper machine for manufacture of absorbent paper, comprising the steps of providing a paper machine having:

(a) a forming loop comprising a headbox and a translating foraminous support;

(b) a dryer section adapted to receive absorbent paper from said forming loop; and (c) a reel adapted to receive absorbent paper from said dryer system;

wherein said dryer section comprises:

(i) a rotable Yankee dryer cylinder internally heated by steam;

(ii) a wet end hood section encompassing a portion of said Yankee dryer cylinder adjacent forming loop;

(iii) a dry end hood section encompassing a portion of said Yankee dryer cylinder adjacent said reel;

(iv) a dryer system exhaust;

(v) a wet end hood supply duct having a first burner disposed therein adapted to supply heated air to said wet end hood section;

(vi) a wet end hood exhaust duct adapted to receive moisture laden air from said wet end hood section;

(vii) a wet end return duct adapted to supply air from said wet end hood exhaust duct to said wet end hood supply duct;

(viii) a dry end hood supply duct having a second burner disposed therein adapted to supply heated air to said dry end hood section;

(ix) a dry end hood exhaust duct adapted to receive moisture laden air from said dry end hood section;

(x) a dry end return duct adapted to deliver air from said dry end hood exhaust duct to said dry end hood supply duct;

(xi) at least one of said supply ducts having an air to air heat exchanger disposed therein adapted for heating air supplied therethrough; and (xii) a diverter damper system adapted to direct moisture laden gas exhausted from one of said hood halves to said heat exchanger and heat air supplied though one of said supply ducts;

comprising the steps of passing moisture laden air from said wet end hood section exhaust duct to said wet end hood supply duct at a temperature of over 550° F. and a moisture content of between 0.2 and 0.7 pounds of water per pound of air, while passing fresh air through an air to air heat exchanger to said wet dry end hood half at a temperature of between 350° F. and 450° F. and discharging air from said dry end hood half to the atmosphere through an air to air heat exchanger.

3. A method of operating a paper machine having a Yankee dryer with a hood which is split between a wet end hood half and a dry end hood half, comprising the steps of:

(a) recirculating air from said wet end hood half through a burner and back to the wet end hood half while introducing sufficient make up air to:

maintain the temperature of the stream returned to said wet end hood half at over about 550° F.; and (ii) maintain the humidity of the air stream returned to said wet end hood half at between about 0.2 and 07 pounds of water per pound of air; while (b) passing fresh air to said dry end hood half at a temperature of between 350° F. and 450° F.; and discharging said air from said dry end hood half to the atmosphere through an air to air heat exchanger.

* * * * *